US005386786A

United States Patent [19]

Kilpatrick et al.

[11] Patent Number: 5,386,786

[45] Date of Patent: Feb. 7, 1995

[54] PREDOMINANTLY PAPERBOARD SPACER COMPRISING INTERLOCKED BEAMS

[75] Inventors: Ted D. Kilpatrick, Ponte Vedra Beach, Fla.; Arthur M. Wagner, Geneva, Ill.; Jerome A. Wilson, Valparaiso, Ind.

[73] Assignee: Gate Pallet Systems, Inc., Crown Point, Ind.

[21] Appl. No.: 217,937

[22] Filed: Mar. 25, 1994

[51] Int. Cl.[6] ..... B65D 19/00

[52] U.S. Cl. ..... 108/51.3; 108/57.1

[58] Field of Search ..... 108/51.3, 51.1, 56.1, 108/57.1; 493/DIG. 964, DIG. 965, 405, 355

[56] References Cited

U.S. PATENT DOCUMENTS

| | | | |
|---|---|---|---|
| 2,709,559 | 5/1955 | Geisler | 248/120 |
| 3,165,078 | 1/1965 | White | 108/51.3 |
| 3,683,822 | 8/1972 | Roberts et al. | 108/51.3 |
| 4,792,325 | 12/1988 | Schmidtke | 108/51.3 |
| 4,979,446 | 12/1990 | Winebarger | 108/51.3 |
| 5,184,558 | 2/1993 | Wozniacki | 108/51.3 |
| 5,218,913 | 6/1993 | Winebarger et al. | 108/51.3 |

FOREIGN PATENT DOCUMENTS

| | | | |
|---|---|---|---|
| 0996516 | 6/1965 | United Kingdom | 108/51.3 |

*Primary Examiner*—Kenneth J. Dorner
*Assistant Examiner*—Gerald A. Anderson
*Attorney, Agent, or Firm*—Dressler, Goldsmith, Shore & Milnamow, Ltd.

[57] ABSTRACT

A spacer comprises two interlocked beams, each folded from a sheet of corrugated paperboard so as to have a base panel and panels on each side of a plane intersecting the base panel approximately at a right angle. In each beam, the panels on each side include a side panel extending from the base panel, an outer panel extending inwardly from the side panel approximately to the intersecting plane, an inner panel extending from the inwardly extending outer panel approximately to the base panel, and panels bracing and reinforcing such beam. Each beam has a notch opening at the base panel and receiving a portion of the other beam. Two tongues including portions of the base panel and portions of the side panels project toward each other and project partly over the notch. Each beam has recesses extending along folds and receiving the projecting tongues of the other beam.

7 Claims, 4 Drawing Sheets

10
12
12
16
16
18
14
4
4
2
2

12
20
32
22
34
30
40
24
P
P
32
22
34
30
40

PREDOMINANTLY PAPERBOARD SPACER COMPRISING INTERLOCKED BEAMS

TECHNICAL FIELD OF THE INVENTION

This invention pertains to an improved spacer made predominantly of paperboard material and comprising two or more beams interlocked in a unique manner that does not require the beams to be adhesively secured to one other. The improved spacer is useful particularly but not exclusively between successive layers of lading on a pallet.

BACKGROUND OF THE INVENTION

Frequently, successive layers of lading are stacked onto a pallet, for shipment or storage. Commonly, spacers are employed to minimize risks of damage being caused when one layer is being stacked onto another, or when one layer is being removed from another.

Flat sheets of corrugated paperboard or other material are useful as spacers between successive layers of lading. However, such sheets may not be entirely satisfactory with some types of lading, particularly with lading that must be widely spaced from layer to layer so as to facilitate removal of each layer.

SUMMARY OF THE INVENTION

Accordingly, this invention provides an improved spacer made predominantly of paperboard material, such as corrugated paperboard or multi-ply paper. The improved spacer can be effectively used with lading to be widely spaced from layer to layer as mentioned above and can be easily assembled from two or more beams without adhesive or fasteners to join the beams to one another.

Generally, the spacer comprises two interlocked beams, each folded from a single sheet of paperboard material so as to have a base panel and panels on each side of a plane intersecting the base panel approximately at a right angle. The panels on each side of the intersecting plane include a side panel attached at a fold in the sheet to and extending from the base panel, along with an outer panel attached at a fold in the sheet to and extending inwardly from the side panel, extending toward and approximately to the intersecting plane.

Moreover, each beam is folded so as to have a series of inner panels including an inner panel that is attached at a fold in the sheet to and extending from the inwardly extending outer panel, toward and approximately to the base panel, and that is secured to a like panel on the other side of the intersecting plane. The inner panel extending toward and approximately to the base panel may be adhesively secured to a like panel on the other side of the intersecting plane.

In accordance with this invention, each beam has a notch opening at the base panel of such beam and extending toward the inwardly extending outer panels of such beam. The notch receives a portion of the other beam and has a profile conforming generally to the profile of the other beam except that each beam has a tongue projecting partly over the notch of such beam. The projecting tongue includes a projecting portion of the base panel of such beam. Each beam has a recess extending along the fold where one of the outer panels of such beam is attached to another of the outer panels of such beam. The recess receives the projecting tongue of the other beam so as to interlock the beams. Preferably, the projecting tongues of each beam include two gussets, each formed from a portion of one of the side panels of said beam.

In a preferred embodiment, the outer panel extending from the base panel of each beam extends at an obtuse angle therefrom, and each beam has a generally trapezoidal profile. Moreover, the notch in each beam has a generally trapezoidal profile flaring outwardly toward the base panel of such beam and conforming generally to the profile of the other beam except that each beam has two tongues projecting toward each other and projecting partly over the notch in such beam. Each projecting tongue includes a projecting portion of the base panel of such beam. Furthermore, each beam has two recesses, each extending along the fold where one of the outer panels of said beam is attached to another of the outer panels of said beam. Each recess receives one of the projecting tongues of the other beam so as to interlock the beams.

In one contemplated arrangement, in which plural beams extend in each of two orthogonal directions, each beam extending in one such direction and at least one of the beams extending in the other direction are interlocked at similar notches. Thus, the stringer may comprise two longitudinally extending beams, a transversely extending beam interlocked with each of the longitudinally extending beams at similar notches, and two additional transversely extending beams, each being interlocked with one of the longitudinally extending beams at similar notches.

Although certain of the inner panels are secured adhesively to each other, it not necessary for the interlocked beams to be adhesively secured to each other. However, the beams may be adhesively secured to each other where interlocked at the notches.

These and other objects, features, and advantages of this invention are evident from the following description of a preferred embodiment of this invention with reference to the accompanying drawings.

DETAILED DESCRIPTION OF PREFERRED EMBODIMENT

Figures 1, 2:
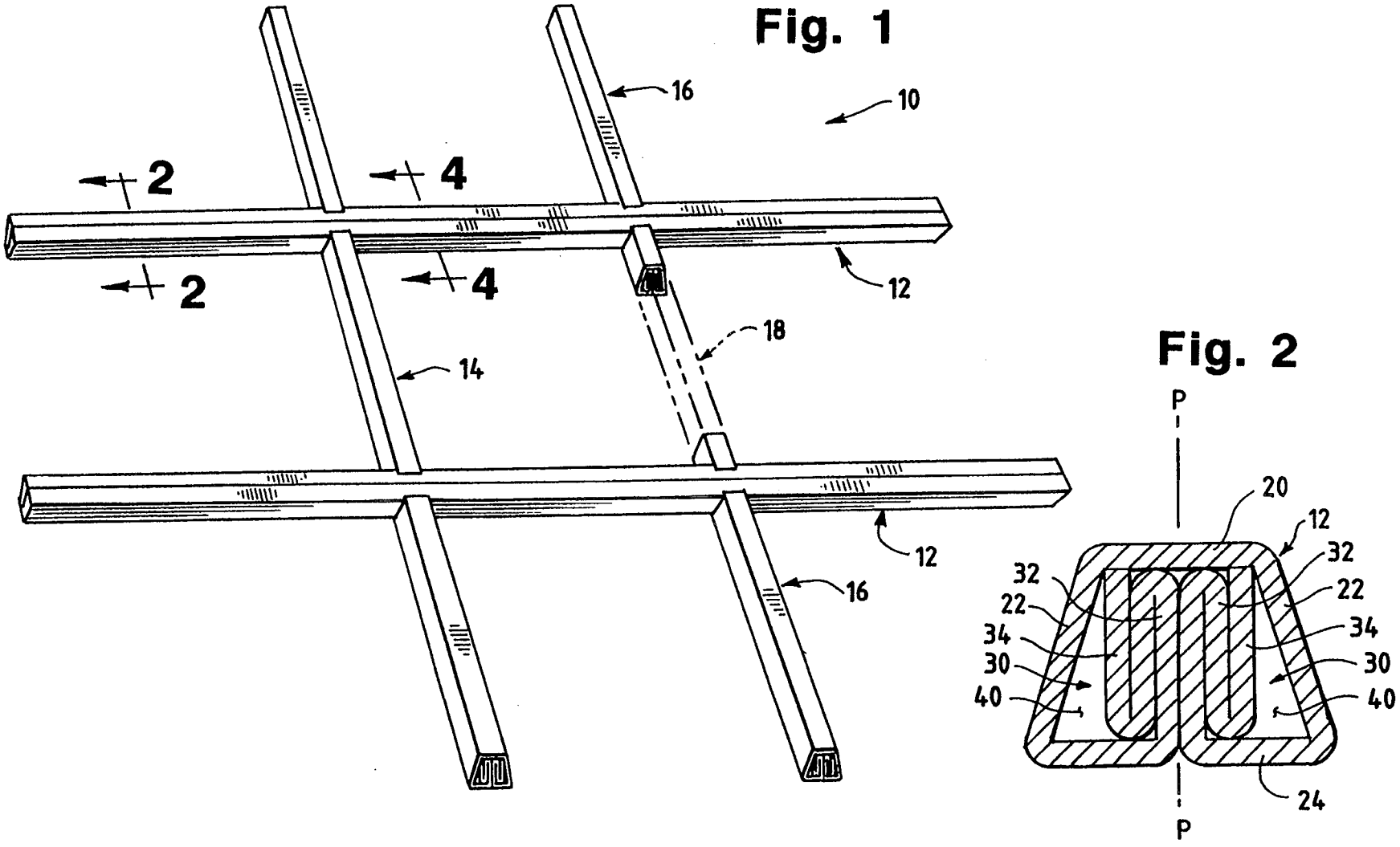
FIG. 1 is a perspective view of a spacer constituting a preferred embodiment of this invention.
FIG. 2, on a larger scale, is a sectional view taken along line 2—2 of FIG. 1, in a direction indicated by arrows.
Figure 3:
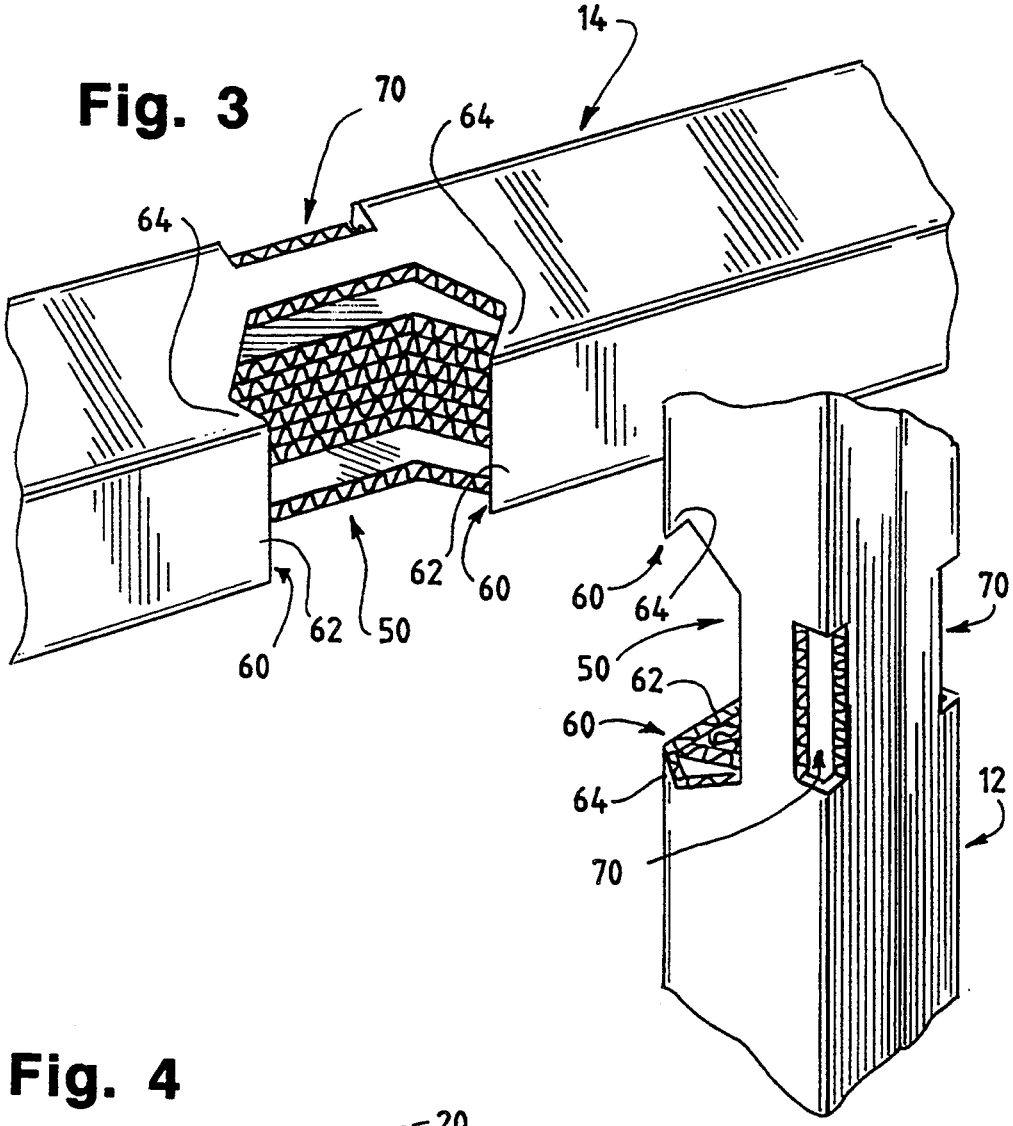
FIG. 3, on a similar scale, is a fragmentary, exploded, perspective view of two beams of the spacer before the beams are interlocked.
Figure 4:
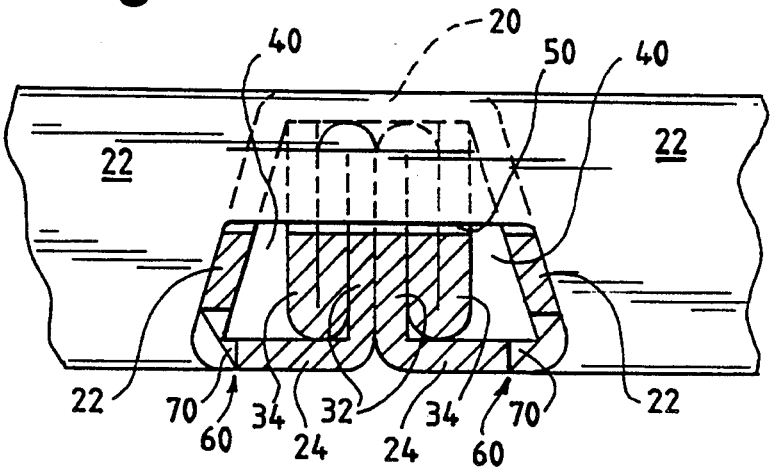
FIG. 4, on a similar scale, is a sectional view taken along line 4—4 of FIG. 1, in a direction indicated by arrows.

As shown in FIG. 1, a spacer 10 constitutes a preferred embodiment of this invention. The spacer 10 is made predominantly of corrugated paperboard, in a grid-like configuration, from beams extending in each of two orthogonal directions. The spacer 10 comprises two longitudinally extending beams 12, a transversely extending beam 14 interlocked with each of the longitudinally extending beams 12, and two transversely extending beams 16, each being interlocked with one of the longitudinally extending beams 12. As indicated in dashed lines in FIG. 1, a transversely extending beam 18 similar to the transversely extending beam 14 and interlocked with each of the longitudinally extending beams 12 may be used in place of the transversely extending beam 16.

Except as illustrated and described herein, each of the longitudinally and transversely extending beams may be substantially similar in its profile to one of the decking members disclosed in Schmidtke U.S. Pat. No. 4,792,325, Quasnick U.S. Pat. No. 4,867,074, and Smith U.S. Pat. No. 5,001,991, the disclosures of which are incorporated herein by reference.

Thus, as exemplified by the beam 12 shown in cross-section in FIG. 2, each beam among the beams 12, 14, 16 (or among the beams 12, 14, 18) is folded from a single sheet of corrugated paperboard, across the flutes of such material, so as to have a base panel 20 and panels on each side of a plane P intersecting and bisecting the base panel 20. The panels on each side of the plane P include a side panel 22 attached at a fold in the sheet to and extending from the base panel 20 and an outer panel 24 attached at a fold in the sheet to and extending inwardly from the side panel 22. The outer panel 24 extends toward and approximately to the plane P.

In each beam, the panels on each side of the plane P also include a series of six inner panels 30 including an innermost panel 32 attached at a fold in the sheet to and extending from the inwardly extending outer panel, toward and approximately to the base panel 20, and a panel 34 nearest to the side panel 22 on the same side thereof. The innermost panel 32 is secured adhesively to the innermost panel 32 on the other side of the plane P, along and across the facing surfaces of the panels 30.

In each beam, the inner panels 30 on each side of the plane P are attached to one another at folds in the sheet and are folded against one another, in a zig-zag pattern, so as to extend generally between the base panel 20 and one of the inwardly extending outer panels 24 and so as to extend generally across the base panel 20, generally between the folds where the base panel 20 is attached to the side panels 22. Further, the inner panels 30 on each side of the plane P are secured adhesively to one another, along and across the facing surfaces of the inner panels 30. Moreover, the inner panels 30 on each side thereof may be adhesively secured to the base panel 20 and to one of the inwardly extending outer panels 24, along folds where the inner panels 30 are attached to one another. Thus, on each side of the plane P, a hollow space 40 having a generally triangular profile is defined by a portion of the base panel 20, by the side panel 22, and by the panel 36 nearest to the side panel 22.

Where each beam is interlocked with another beam in the spacer 10, each beam has a notch 50 opening at the base panel 20 of such beam and extending toward the outer panels 24 of such beam. As exemplified by the blank shown in FIG. 5, each notch 50 in each beam is defined by cut-away portions of the base panel 20, side panels 22, and inner panels 30 of such beam. Moreover, each notch 50 receives a portion 52 of the beam interlocked with such beam, which portion 52 is adjacent to a like notch 50 in the beam interlocked therewith.

Each notch 50 in each beam has a profile conforming generally to the profile of each other beam except that each beam has two tongues 60 associated with each notch 50 in such beam. The tongues 60 associated with each notch 50 in each beam project toward each other and project partly over such notch 50. Each projecting tongue 60 of each beam includes a projecting portion 62 of the base panel 20 of such beam and two gussets 64, each formed from an adjacent, generally triangular portion of one of the side panels 22 of such beam.

Where each beam is interlocked with another beam in the spacer 10, each beam has two recesses 70, each extending through the sheet folded to provide such beam, into one of the hollow spaces 40. Each recess 70 extends along a fold where one of the side panels 22 of such beam is attached to one of the outer panels 24 of such beam, in the portion 52 received by the notch 50 in the beam interlocked with such beam. Each recess 70 receives one of the tongues 60 projecting partly over a like notch 50 in the beam interlocked therewith so as to interlock the beams.

Because the longitudinal and transverse beams are interlocked by means of the tongues 50 received in the recesses 70, it is not necessary for the interlocked beams to be adhesively secured to one another. However, the interlocked beams may be adhesively secured to one another, where the portions 52 of the respective beams are received by the notches 50 and where the tongues 60 of the respective beams are received by the recesses 70.

If an adhesive is employed to secure the interlocked beams to one another, however, a so-called "cold melt" or "cold set" adhesive is preferred, such as Code No. 3715 or Code No. 3715B, which are available commercially from H. B. Fuller Co. of Palatine, Ill.

Figure 5:
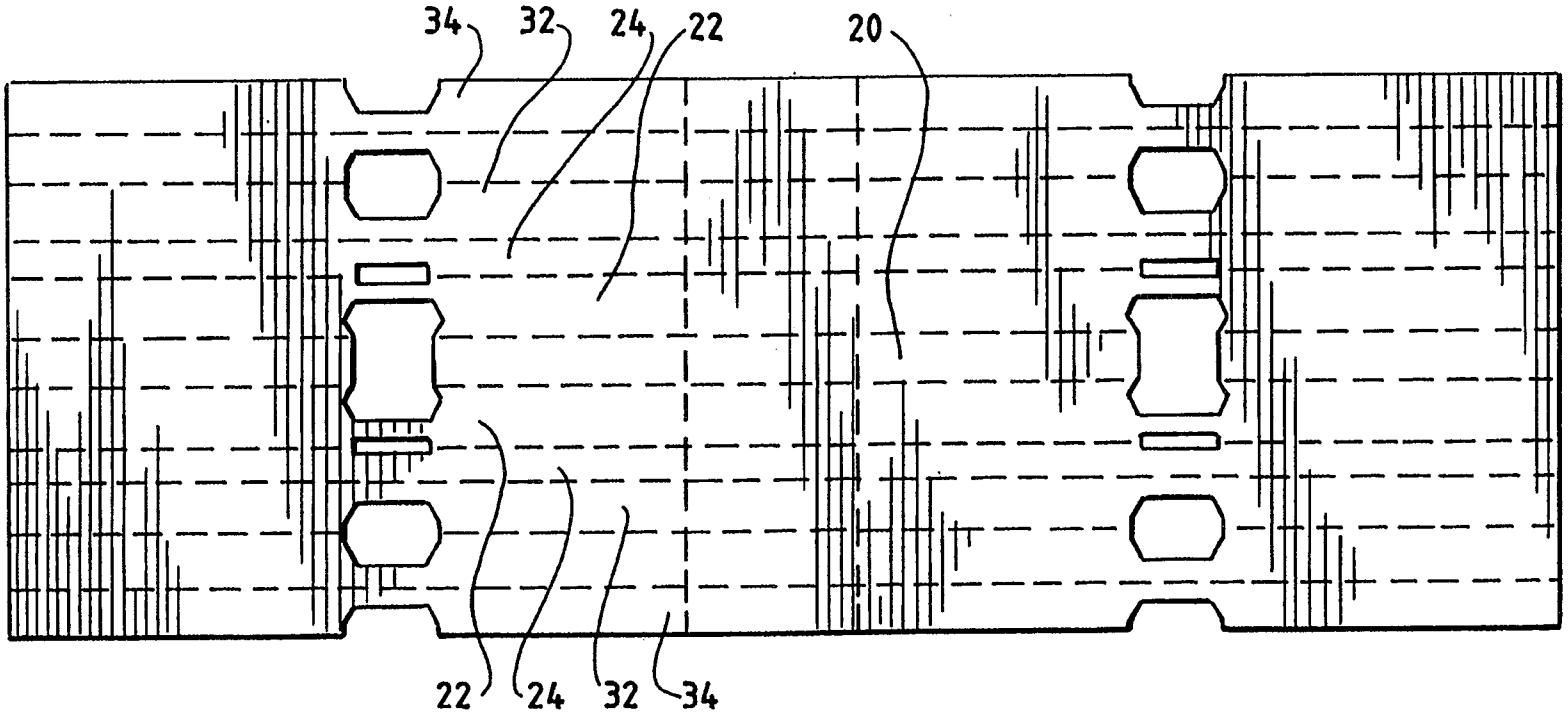
FIG. 5, on a similar scale, is a fragmentary, plan view of a blank, from which a representative one of the beams is folded.
Figure 6:
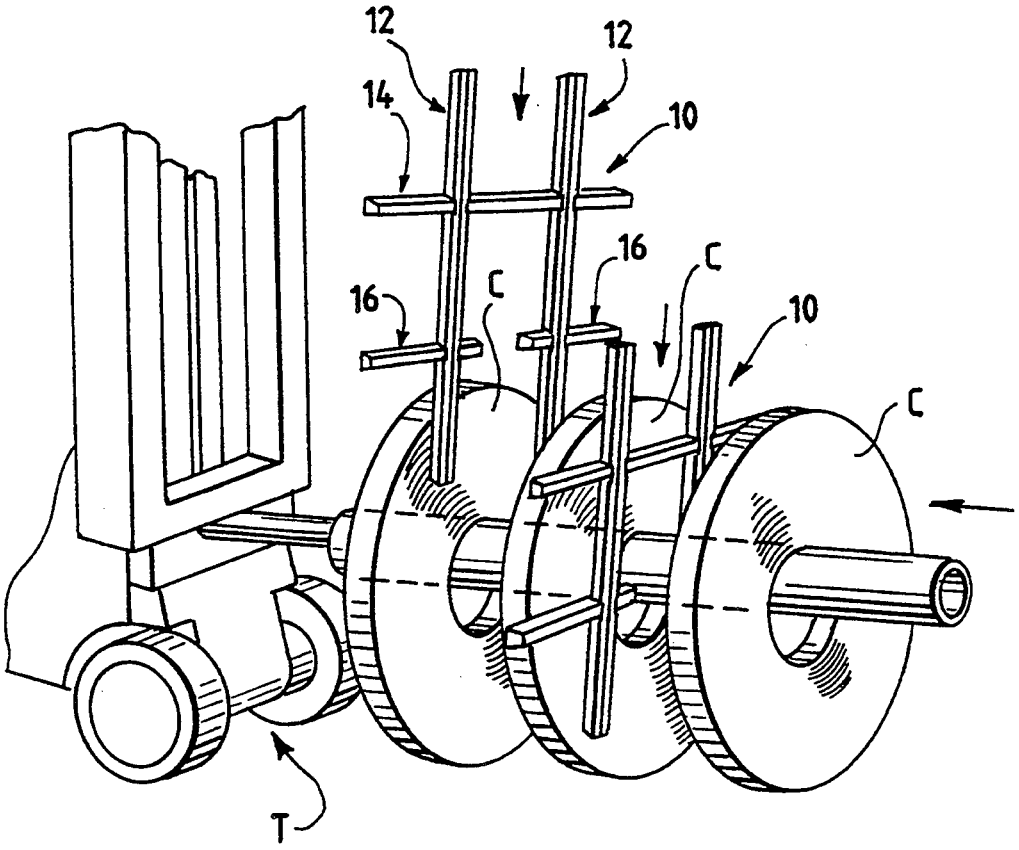
FIG. 6 is a fragmentary, perspective view illustrating one contemplated application of the spacer, which is one of several similar spacers used between sheet metal coils on a spindle. As shown, a lift truck is holding the spindle so as to permit the spacers to be properly positioned between the coils, on the spindle.

One contemplated usage of the spacer 10 comprising the longitudinally extending beam 12, the transversely extending beams 14, and the transversely extending beams 16 is illustrated in FIG. 5. The spacer 10 has a gap between the transversely extending beams 16, which gap permits the spacer 10 to be easily inserted between two coils C of sheet metal, on a spindle S supported by a lift truck T. The spindle S supporting several such coils C with spacers like the spacer 10 between the respective coils C may be then placed on a pallet (not shown) with another spacer like the spacer 10 between the lowermost coil and the pallet.

As mentioned above, the transversely extending beam 18 may be used in place of the transversely extending beams 16 with the gap therebetween, whereupon the spacer 10 may be used on a pallet (not shown) between lading of any of a wide range of other types.

Whether the spacer 10 employs the transversely extending beams 16 with the gap therebetween or the transversely extending beam 18 in place thereof, the spacer 10 is suitable for other similar and dissimilar uses. As an example, the spacer 10 may be used in an interior door (not shown) between two thin sheets (not shown ) of plywood.

Various other modifications may be made in the preferred embodiment described above without departing from the scope and spirit of this invention.

We claim:

1. A spacer comprising two interlocked beams, each beam being folded from a single sheet of paperboard material so as to have a base panel and panels on each side of a plane intersecting the base panel approximately at a right angle and so that the panels on each side of the intersecting plane include (a) a side panel attached at a fold in the sheet to and extending from the base panel, (b) an outer panel attached at a fold in the sheet to and extending inwardly from the side panel, toward and approximately to the intersecting plane, (c) a series of inner panels including an inner panel attached at a fold in the sheet to and extending from the inwardly extending outer panel, toward and approximately to the base panel, each beam having a notch opening at the base panel of said beam and extending toward the inwardly extending outer panels of said beam, the notch receiving a portion of the other beam and having a profile conforming generally to the profile of the other beam except that each beam has a tongue projecting partly over the notch of said beam, the projecting tongue including a projecting portion of the base panel of said beam, and each beam having a recess extending along the fold where one of the outer panels of said beam is attached to another of the outer panels of said beam, the recess receiving the projecting tongue of the other beam so as to interlock the beams.

2. The spacer of claim 1 wherein the inner panel attached at a fold in the sheet thereto and extending therefrom is secured adhesively to a like panel on the other side of the intersecting plane.

3. The spacer of claim 2 wherein the outer panel extending from the base panel of each beam extends at an obtuse angle therefrom, each beam having a generally trapezoidal profile, and wherein the notch in each beam has a generally trapezoidal profile flaring outwardly toward the base panel of said beam and conforming generally to the generally trapezoidal profile of the other beam except that each beam has two such tongues projecting toward each other and projecting partly over the notch in said beam, each projecting tongue including a projecting portion of the base panel of said beam, and wherein the recess in each beam is one of two recesses, each extending respectively along the fold where one of the outer panels of said beam is attached to another of the outer panels of said beam, each recess receiving one of the projecting tongues of the other beam so as to interlock the beams.

4. The spacer of claim 3 wherein the projecting tongues of each beam include two gussets, each formed from a portion of one of the side panels of said beam.

5. The spacer of claim 3 wherein the beams include beams extending in each of two orthogonal directions and wherein each beam extending in one such direction and at least one of the beams extending in the other direction are interlocked at similar notches.

6. The spacer of claim 5 wherein the beams include two longitudinally extending beams, a transversely extending beam interlocked with each of the longitudinally extending beams at similar notches, and two additional transversely extending beams, each being interlocked with one of the longitudinally extending beams at similar notches.

7. The spacer of any preceding claim wherein the beams are secured adhesively to one another where interlocked at the notches.

* * * * *